US009033002B2

(12) United States Patent
Kato et al.

(10) Patent No.: US 9,033,002 B2
(45) Date of Patent: May 19, 2015

(54) OPERATION PATTERN SWITCHING DEVICE

(71) Applicant: KUBOTA CORPORATION, Osaka-shi, Osaka (JP)

(72) Inventors: Yoshihiro Kato, Sakai (JP); Toshihiro Nakao, Sakai (JP)

(73) Assignee: Kubota Corporation, Osaka (JP)

( * ) Notice: Subject to any disclaimer, the term of this patent is extended or adjusted under 35 U.S.C. 154(b) by 124 days.

(21) Appl. No.: 13/956,931

(22) Filed: Aug. 1, 2013

(65) Prior Publication Data

US 2014/0034160 A1 Feb. 6, 2014

(30) Foreign Application Priority Data

Aug. 1, 2012 (JP) ..... 2012-171236

(51) Int. Cl.

| | |
|---|---|
| ***E02F 3/43*** | (2006.01) |
| ***G05G 5/06*** | (2006.01) |
| ***E02F 9/20*** | (2006.01) |
| ***E02F 9/22*** | (2006.01) |

(52) U.S. Cl.

CPC .. *E02F 3/43* (2013.01); *G05G 5/06* (2013.01); *E02F 9/2012* (2013.01); *E02F 9/2285* (2013.01)

(58) Field of Classification Search

CPC ..... E02F 3/43; E02F 9/20; E02F 9/2012; G05G 5/06

USPC ..... 137/636

See application file for complete search history.

(56) References Cited

U.S. PATENT DOCUMENTS 5,116,187 A * 5/1992 Fukuda et al. ..... 37/348
7,530,225 B2 * 5/2009 Ikeda ..... 60/421

FOREIGN PATENT DOCUMENTS

JP 2010-230121 A 10/2010
JP 4846870 B2 12/2011

* cited by examiner

*Primary Examiner* — Kevin Lee
(74) *Attorney, Agent, or Firm* — Birch, Stewart, Kolasch & Birch, LLP

(57) ABSTRACT

To improve operability of a switching operation and locking operation of an operation pattern switching valve for switching the operation pattern of controlling devices for actuator control valves. An operation pattern switching device has a rotating operation member that rotates around a shaft center of a rotating support shaft, and thereby performs a switching operation of the operation pattern switching valve; and an operation lever that is provided rotatably integrally with the rotating operation member and performs a rotating operation of the rotating operation member. The rotating support shaft is, at each pattern switching position of the operation pattern switching valve, in a circumferential direction, provided with a plurality of lock engagement parts each with which the operation lever engages. The operation lever moves in a direction orthogonal to the shaft center of the rotating support shaft, and be thereby made engageable/removable with/from each of the lock engagement parts.

5 Claims, 10 Drawing Sheets

OPERATION PATTERN SWITCHING DEVICE

TECHNICAL FIELD

The present invention relates to an operation pattern switching device for a hydraulic shovel (hydraulic excavator) or the like in a working machine such as a backhoe.

BACKGROUND ART

In a working machine such as a backhoe, for example, a revolving control valve for a revolving motor that revolves a machine body, a boom control valve for a boom cylinder that swings a boom, an arm control valve for an arm cylinder that swings an arm, and a bucket control valve for a bucket cylinder that swings a bucket are respectively subjected to pilot operations by left and right controlling devices.

Each of the controlling devices is provided with: a pilot valve; and a controlling lever for controlling the pilot valve, and the controlling lever is adapted to be longitudinally and laterally operable with tilting.

Operation patterns of the left and right controlling devices include, for example, an operation pattern referred to as a so-called ISO pattern that is internationally unified. This operation pattern is one in which with one of the controlling levers, the arm control valve is operated by the lateral tilting operation, and the revolving control valve is operated by the longitudinal tilting operation, whereas with the other controlling lever, the bucket control valve is operated by the lateral tilting operation, and the boom control valve is operated by the longitudinal tilting operation.

Also, in a market, a working machine having an operation pattern other than the ISO pattern is active.

Accordingly, there is a working machine provided with an operation pattern switching device that can, in order to be able to select any of a plurality of operation patterns, switch an operation pattern of controlling devices to any of the plurality of operation patterns (see Japanese Unexamined Patent Publication JP-A2010-230121 and Japanese Patent No. 4846870).

In this working machine, in hydraulic pipe lines from the controlling devices to control valves, an operation pattern switching valve that switches an operation pattern is set, and the operation pattern switching valve is configured to include a rotary valve provided with a rotating spool in a valve body. The rotating spool is subjected to a switching operation by an operation lever, and locked by locking means so as not to move.

In the working machine described in Japanese Unexamined Patent Publication JP-A2010-230121, a lever bracket that rotates integrally with the rotating spool is provided with the operation lever, and by rotating the rotating spool with gripping the operation lever, the switching operation is performed. Also, the lever bracket is provided with an engaging piece to fix a fixing bracket to the valve body, and at a switching position of the rotating spool, the engaging piece of the lever bracket and the fixing bracket are fixed to each other with a bolt and a nut, whereby the rotating spool is locked so as not to move.

In the working machine described in Japanese Patent No. 4846870, the operation lever for performing the switching operation of the rotating spool is fixed to a shaft fixed to the rotating spool, and at a switching position of the rotating spool, a bolt screwed into a screw hole that is formed in the valve body with penetrating through the operation lever locks the rotating spool so as to prevent the rotating spool from moving.

SUMMARY OF INVENTION

Technical Problem

In the conventional working machine, the switching operation and locking operation of the operation pattern switching valve are separately performed, and therefore there is a problem that the operations are complicated.

For this reason, the present invention is, in consideration of the problem, intended to provide an operation pattern switching device that can perform the switching operation and locking operation of an operation pattern by a series of actions.

Solution to Problem

Technical means taken by the present invention in order to solve the technical problem are characterized by the following respects.

A first aspect of the present invention has:

an operation pattern switching valve that is set in hydraulic pipe lines between a plurality of actuator control valves that is, in order to control a plurality of hydraulic actuators equipped in a working machine, provided corresponding to the plurality of hydraulic actuators, and controlling devices that perform pilot operations of the plurality of actuator control valves, and switches an operation pattern of the controlling devices for the plurality of actuator control valves to any of a plurality of operation patterns;

a rotating operation member that rotates with being supported by a rotating support shaft rotatably around a shaft center, and thereby performs a switching operation of the operation pattern switching valve; and an operation lever that is provided rotatably integrally with the rotating operation member and performs a rotating operation of the rotating operation member, wherein:

the rotating support shaft is, in order to lock the rotating operation member at each switching position of the operation pattern switching valve, in a circumferential direction, provided with a plurality of lock engagement parts each with which the operation lever engages; and the operation lever is supported by the rotating operation member movably in a direction orthogonal to a shaft center of the rotating support shaft, and also moves in the moving direction to be thereby made engageable/removable with/from each of the lock engagement parts.

A second aspect of the present invention is characterized in that: the rotating operation member is, in a shaft center direction of the rotating support shaft, provided with a pair of main components formed of a plate material; each of the main components is provided with a rotating support part that is supported by the rotating support shaft rotatably around the shaft center with being fitted at an outside of the rotating support shaft, and a lever supporting part that extends from the rotating support part outward in a radial direction of the rotating support shaft; the rotating support parts and the lever supporting parts are respectively provided at intervals in the shaft center direction of the rotating support shaft; on a fore end side between the lever supporting parts, a guide tube that guides the operation lever movably in the direction orthogonal to the shaft center of the rotating support shaft; and between the guide tube and the rotating support shaft, a spring that biases the operation lever such that the operation lever engages with any of the lock engagement parts is provided.

A third aspect of the present invention is characterized in that: each of the main components of the rotating operation member is provided with an interlocking arm that is extended from the rotating support part and interlocked with and connected to the operation pattern switching valve through an interlocking member; and the rotating support part, the lever supporting part, and the interlocking arm part are formed of one sheet of plate material.

Advantageous Effects of Invention

According to the present invention, the following effects are produced.

According to the first aspect of the present invention, in a state where the operation lever engages with any of the lock engagement parts, the rotating operation member is locked so as not to move, and therefore a switching operation of the operation pattern switching valve cannot be performed. In the case of switching an operation pattern from this state, to remove the operation lever from the lock engagement part, the operation lever is subjected to a moving operation. In doing so, the locking of the rotating operation member is released to make the rotating operation member rotatable, and therefore by performing a rotating operation of the rotating operation member with the operation lever while maintaining the unlocked state, the operation pattern switching valve is subjected to the switching operation. By, at a position to which the operation pattern switching valve is switched, to make the operation lever engages with another lock engagement part, moving the operation lever to lock the rotating operation member, the operation pattern switching valve is locked.

As described, in the first aspect of the present invention, the switching operation and locking operation of the operation pattern switching valve can be performed by a series of actions, and therefore operability is good.

According to the second aspect of the present invention, employed is a configuration in which the rotating support parts and lever supporting parts of the main components formed of a plate material are respectively provided at intervals in the shaft center direction of the rotating support shaft to provide the guide tube on the fore end side between the lever supporting parts, and also between the guide tube and the rotating support shaft, the spring that biases the operation lever is provided, and therefore the insertion arrangement of the spring between the lever supporting parts and the insertion of the operation lever into the spring and guide tube can be easily performed to facilitate assembling.

According to the third aspect of the present invention, the rotating support part, lever supporting part, and interlocking arm part are formed of one sheet of plate material, and therefore the operation pattern switching device can be provided at low cost.

DESCRIPTION OF EMBODIMENTS

Figure 1:
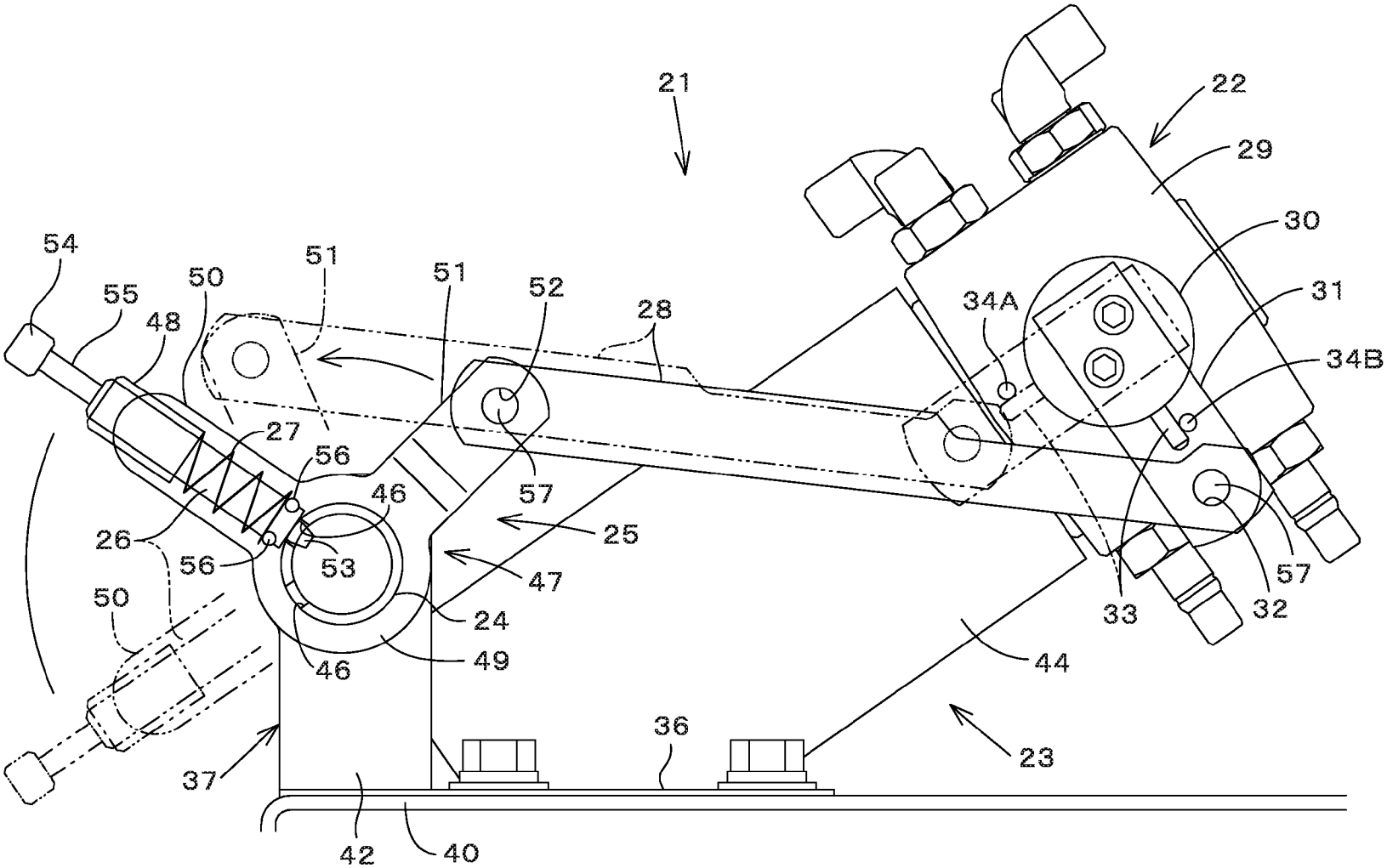
FIG. 1 is a side view of an operation pattern switching device.

In the following, an embodiment of the present invention is described referring to the drawings.

Figure 9:
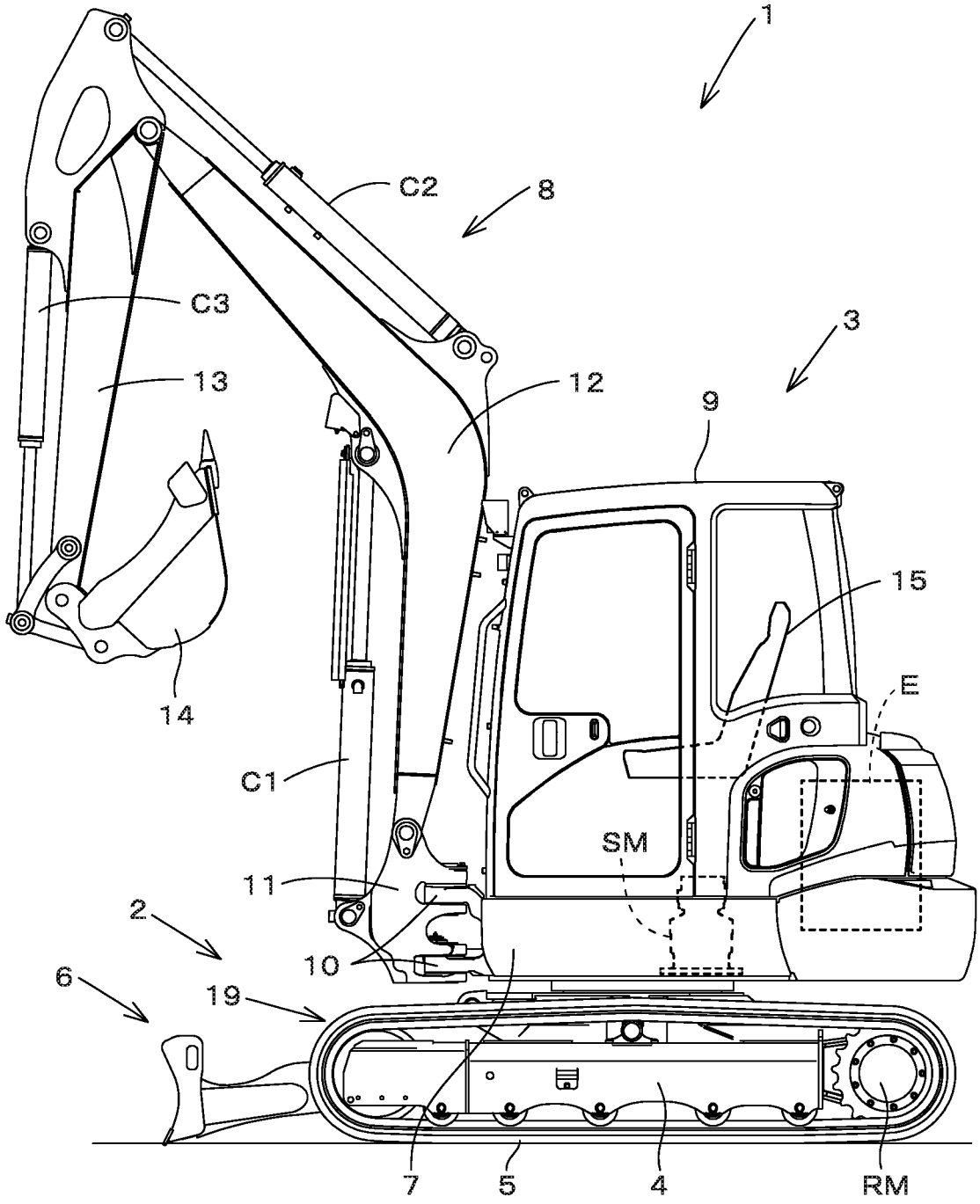
FIG. 9 is a side view of a backhoe.

In FIG. 9, reference numeral 1 represents a backhoe that is exemplified as a working machine (revolving working machine).

The backhoe 1 is configured to mainly include: a lower traveling body 2; and an upper revolving body 3 that is mounted on the traveling body 2 so as to be revolvable around a vertical pivot center.

The traveling body 2 is, on both of left and right sides of a truck frame 4, provided with crawler type traveling units 19, respectively, each of which is configured to circulate and rotationally drive a crawler belt 5 in a circumferential direction by a traveling motor RM including a hydraulic motor.

On a front side of the truck frame 4, a dozer unit 6 is provided, and a blade of the dozer unit 6 is made movable up and down by expansion and contraction of a dozer cylinder including a hydraulic cylinder.

The revolving body 3 is provided with: a revolving base 7 that is mounted on the truck frame 4 so as to be revolvable (rotatable) around a pivot center and constitutes a machine body; a front operating unit (excavating unit) 8 that is equipped on a front side of the revolving base 7; and a cabin 9 that is mounted on the revolving vase 7.

The revolving base 7 is provided with an engine E, radiator, fuel tank, operating oil tank, battery, and the like, and made revolvably driven by a revolving motor SM (hydraulic actuator) including a hydraulic motor.

Also, on the front side of the revolving base 7, a swing bracket 11 that is supported swingably left and right around a vertical shaft center by support brackets 10 that are provided with protruding forward from the revolving base 7 is provided. The swing bracket 11 is made swingably operated left and right by expansion and contraction of a swing cylinder including a hydraulic cylinder.

The front operating unit 8 is configured to mainly include: a boom 12 that is made swingable up and down by a base part side that is pivotally connected to an upper part of the swing bracket 11 so as to be rotatable around a lateral shaft; an arm 13 that is made swingable back and forth (dump/crowd operable) by a base part side that is pivotally connected to a fore end side of the boom 12 so as to be rotatable around a lateral shaft; and a bucket 14 that is made swingable back and forth (dump/crowd operable) by being pivotally connected to a fore end side of the arm 13 so as to be rotatable around a lateral shaft.

The boom 12 performs an upward operation by expanding a boom cylinder C1 that is set between the boom 12 and the swing bracket 11, and by contracting the boom cylinder C1, performs a downward operation.

The arm 13 is swung backward to perform a crowd operation (shoveling operation) by expanding an arm cylinder C2 that is set between the arm 13 and the boom 12, and by contracting the arm cylinder C2, swung forward to perform a dump operation.

The bucket 14 is swung backward to perform the crowd operation (scooping operation) by expanding a bucket cylinder C3 that is set between the bucket 14 and the arm 13, and by contracting the bucket cylinder C3, swung forward to perform the dump operation.

The boom cylinder C1, arm cylinder C2, and bucket cylinder C3 are respectively configured to include hydraulic cylinders (hydraulic actuators).

Inside the cabin 9, an operator's seat 15 is provided.

Figure 8:
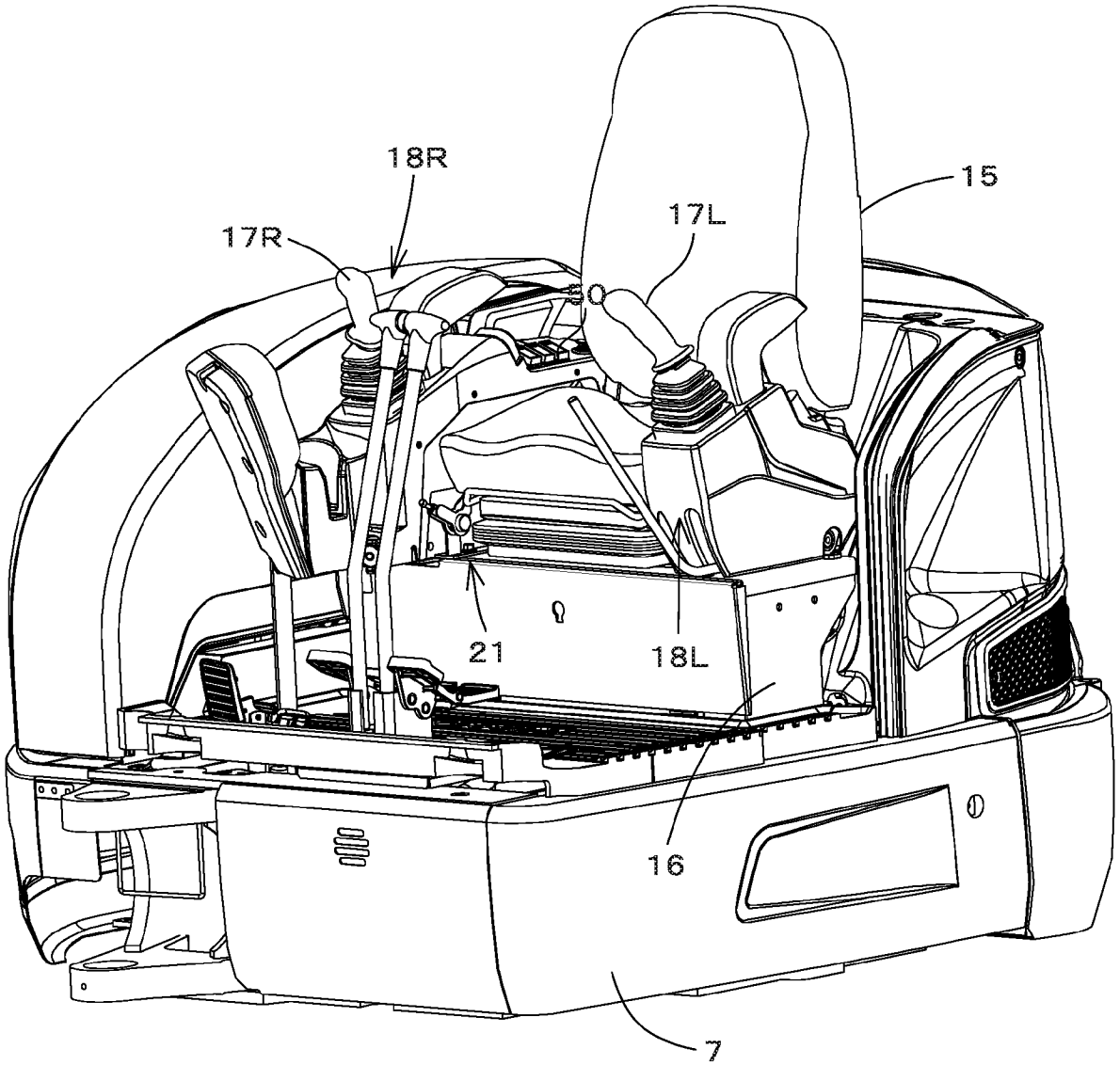
FIG. 8 is a perspective view around an operator's seat.

As illustrated in FIG. 8, the operator's seat 15 is attached on a seat base 16 provided on the revolving base 7, and on both of left and right sides of the operator's seat 15, controlling devices 18L and 18R having controlling levers 17L and 17R are respectively provided.

Figure 7:
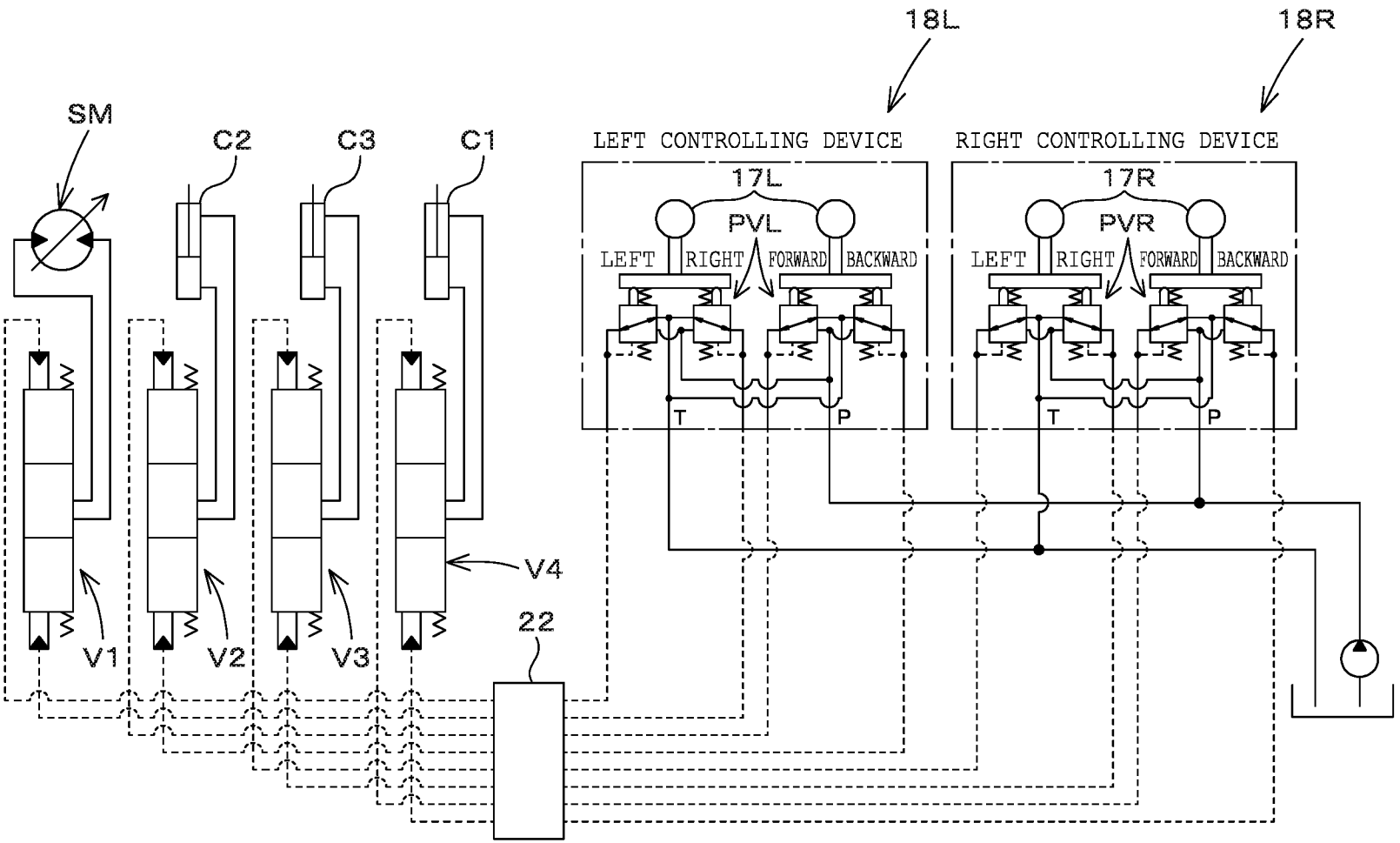
FIG. 7 is a hydraulic circuit diagram.

The left and right controlling devices 18L and 18R are, as illustrated in FIG. 7, in the present embodiment, ones that perform pilot operations of: a revolving control valve V1 that controls the revolving motor SM; an arm control valve V2 that controls the arm cylinder C2; a bucket control valve V3 that controls the bucket cylinder C3; and a boom control valve V4 that controls the boom cylinder C1.

Also, the left and right controlling devices 18L and 18R are provided with pilot valves PVL and PVR that are operated with the controlling levers 17L and 17R, respectively, and each of the controlling levers 17L and 17R is adapted to be operable with being longitudinally or laterally tilted.

The longitudinal tilting operation of one of the left and right controlling levers 17L and 17R causes one of the four control valves V1 to V4 to be operated, and the lateral tilting operation of the one controlling lever 17L or 17R causes one of the remaining three control valves to be operated, whereas the longitudinal tilting operation of the other one of the left and right controlling levers 17L and 17R causes one of the remaining two control valves to be operated, and the lateral tilting operation of the other controlling lever 17L or 17R causes the remaining one control valve to be operated.

As illustrated in FIG. 8, on a right side of the operator's seat 15, an operation pattern switching device 21 that switches an operation pattern of the controlling devices 18L and 18R is arranged.

Figure 2:
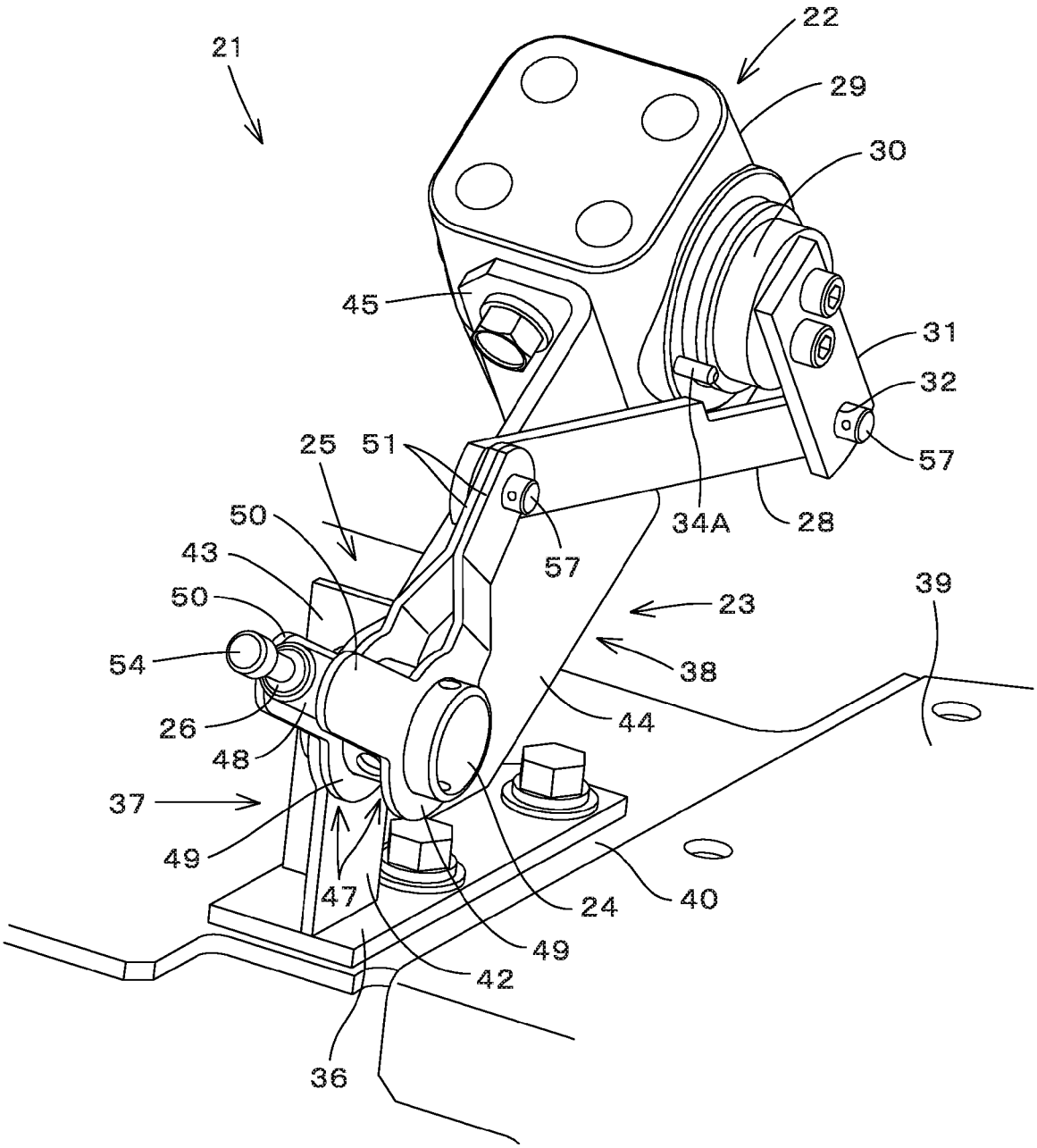
FIG. 2 is a perspective view of the operation pattern switching device as viewed from obliquely forward right.
Figure 3:
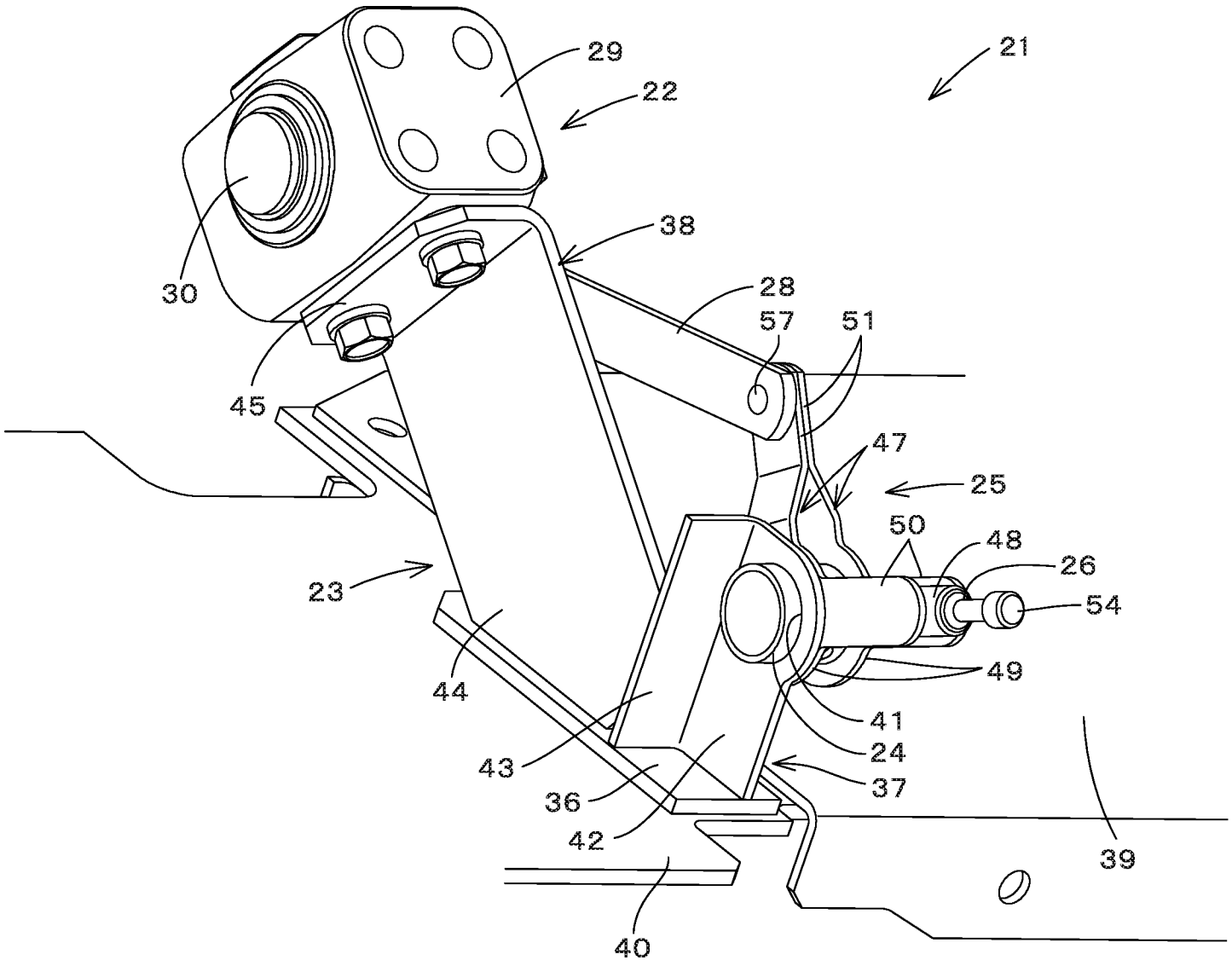
FIG. 3 is a perspective view of the operation pattern switching device as viewed from obliquely forward left.

As illustrated in FIGS. 1, 2, and 3, the operation pattern switching device 21 has an operation pattern switching valve 22, attaching bracket 23, rotating support shaft 24, rotating operation member 25, operation lever 26, spring 27, and interlocking member 28.

The operation pattern switching valve 22 is, as illustrated in FIG. 7, set in hydraulic pipe lines from the left and right controlling devices 18L and 18R to the revolving control valve V1, arm control valve V2, bucket control valve V3, and boom control valve V4, and one that switches an operation pattern of the controlling devices 18L and 18R for the control valves V1 to V4.

The operation pattern switching valve 22 includes a rotary valve that is adapted to be, in a valve body 29 connected with a hydraulic hose, provided with a rotating spool 30 rotatably around a lateral shaft.

As illustrated in FIG. 1, on a left lateral surface of the rotating spool 30, one end side (base end side) of an operation arm 31 is fixed, and the other end side (fore end side) of the operation arm 31 protrudes from the rotating spool 30 outward in a radial direction of the rotating spool 30.

The fore end side of the operation arm 31 is provided with a pin insertion hole 32.

Also, a left lateral part of the rotating spool 30 is provided with a stopper pin 33 that protrudes from a circumferential surface outward in the radial direction, and on a lateral side surface of the valve body 29, regulation pins 34A and 34B that regulate the rotation of the rotating spool 30 by being touched by the stopper pin 33 are provided.

The regulation pins 34A and 34B are provided as a front and back pair at an interval in a circumferential direction of the rotating spool 30, and the front side regulation pin 34A is positioned at an obliquely lower side on a front side of the rotating spool 30, and touched by the stopper pin 33 from a lower side to thereby regulate clockwise rotation of the rotating spool 30, whereas the back side regulation pin 34B is positioned at an obliquely lower side on a back side of the rotating spool 30, and touched by the stopper pin 33 from a front side to thereby regulate anticlockwise rotation of the rotating spool 30. In the present embodiment, the rotating spool 30 is adapted to be rotatable by approximately 90 degrees.

In the present embodiment, the operation pattern switching valve 22 is adapted to be switchable between two positions, i.e., a first pattern switching position where the stopper pin 33 touches the back side regulation pin 34B and a second pattern switching position where the stopper pin 33 touches the front side regulation pin 34A, and thereby an operation pattern of the controlling devices 18L and 18R is made switchable (changeable) between two operation patterns.

To cite an example of the operation pattern of the controlling devices 18L and 18R, the first pattern is one in which, in the case of the left controlling lever 17L, tilting left causes the revolving base 7 to revolve anticlockwise; tilting right causes the revolving base 7 to revolve clockwise; tilting forward causes the arm 13 to perform the dump operation; and tilting backward causes the arm 13 to perform the crowd operation, and in the case of the right controlling lever 17R, tilting left causes the bucket 14 to perform the crowd operation; tilting right causes the bucket 14 to perform dumping; tilting forward causes the boom 12 to perform the downward operation; and tilting backward causes the boom 12 to perform the upward operation.

Also, the second operation pattern is one in which, in the case of the left controlling lever 17L, tilting left causes the arm 13 to perform the dump operation; tilting right causes the arm 13 to perform the crowd operation; tilting forward causes the revolving base 7 to revolve clockwise; and tilting backward causes the revolving base 7 to revolve anticlockwise, and in the case of the right controlling lever 17R, the operation pattern is the same as the above-described first operation pattern.

Each of the operation patterns is not limited to the above-described one, but may be another operation pattern. Also, the present invention may be made switchable among three or more operation patterns.

Figure 5:
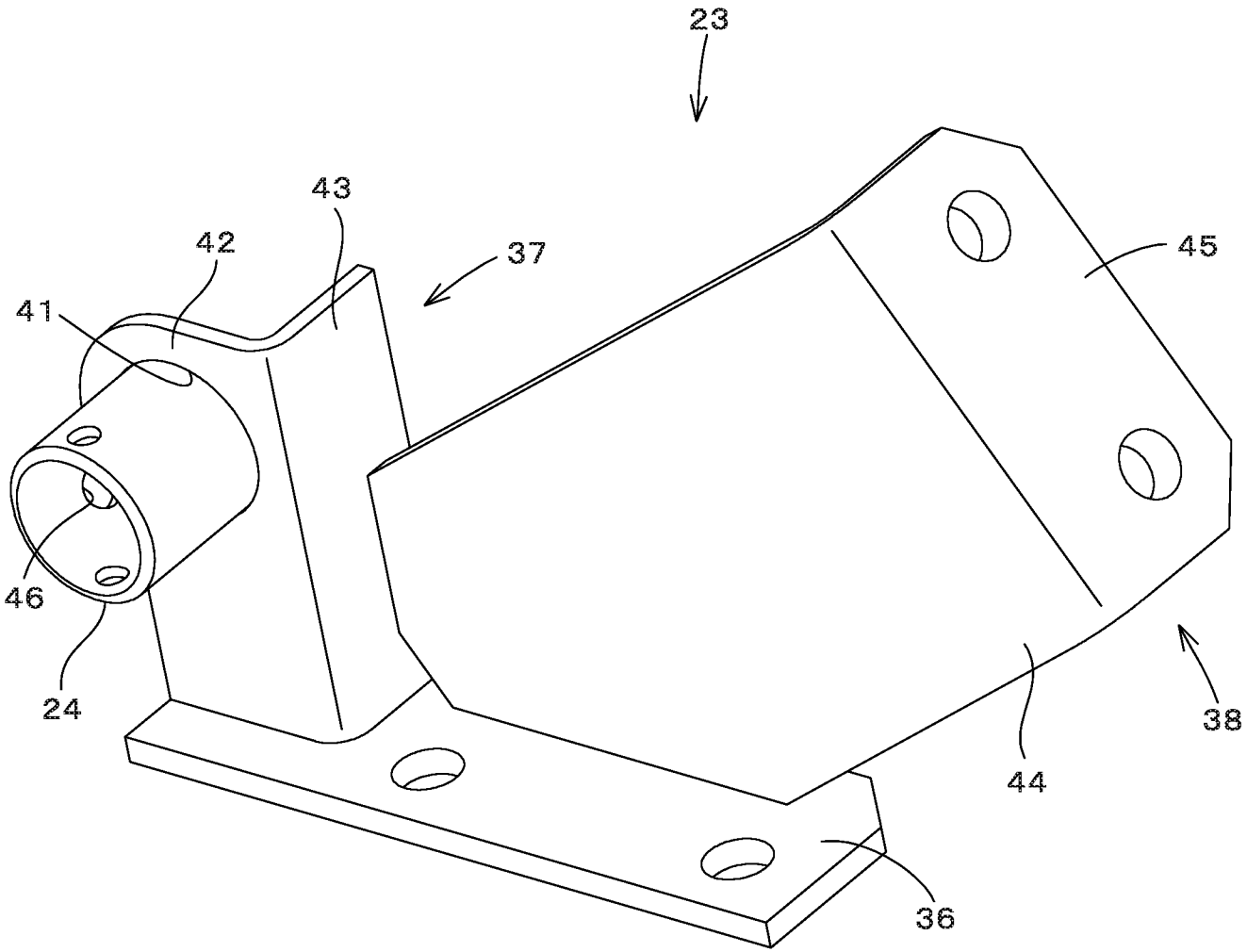
FIG. 5 is a perspective view of an attaching bracket.

The attaching bracket 23 is, as illustrated in FIG. 5, configured to include: an attaching plate 36; a shaft supporting plate 37 that is provided upright on a front part of the attaching plate 36; and a valve attaching plate 38 that extends backward and upward from the attaching plate 36 and shaft supporting plate 37.

The attaching plate 36 is formed in a flat plate shape, and as illustrated in FIGS. 2 and 3, with bolts, fixed on a bracket attaching part 40 that is provided on a right side of an operator's seat attaching part 39 of the seat base 16.

The shaft supporting plate 37 is formed of: a side wall 42 of which a plate face faces in a lateral direction; and a back wall 43 extended laterally (in a right lateral direction) from a back end of the side wall 42, which is bent in an L-shape in a plan view. In an upper part of the side wall 42, a shaft supporting hole 41 is formed with penetrating.

The valve attaching plate 38 is configured to include: a side wall 44 of which a front end is fastened on a back surface of the back wall 43 of the shaft supporting plate 37 and a front lower end is fastened on the upper surface of the attaching plate 36; and a valve attaching wall 45 that is extended laterally (in the right lateral direction) from a back end of the side wall 44.

The valve body 29 of the operation pattern switching valve 22 is fixed on the valve attaching wall 45 with bolts.

The rotating support shaft 24 is configured to include a cylindrical member having a lateral shaft center, of which a right end side is inserted into the shaft supporting hole 41 in the upper part of the side wall 42 of the shaft supporting plate 37, and welded and fixed to the side wall 42. Accordingly, the rotating support shaft 24 is adapted to protrude left from the side wall 42 of the shaft supporting plate.

Figure 4:
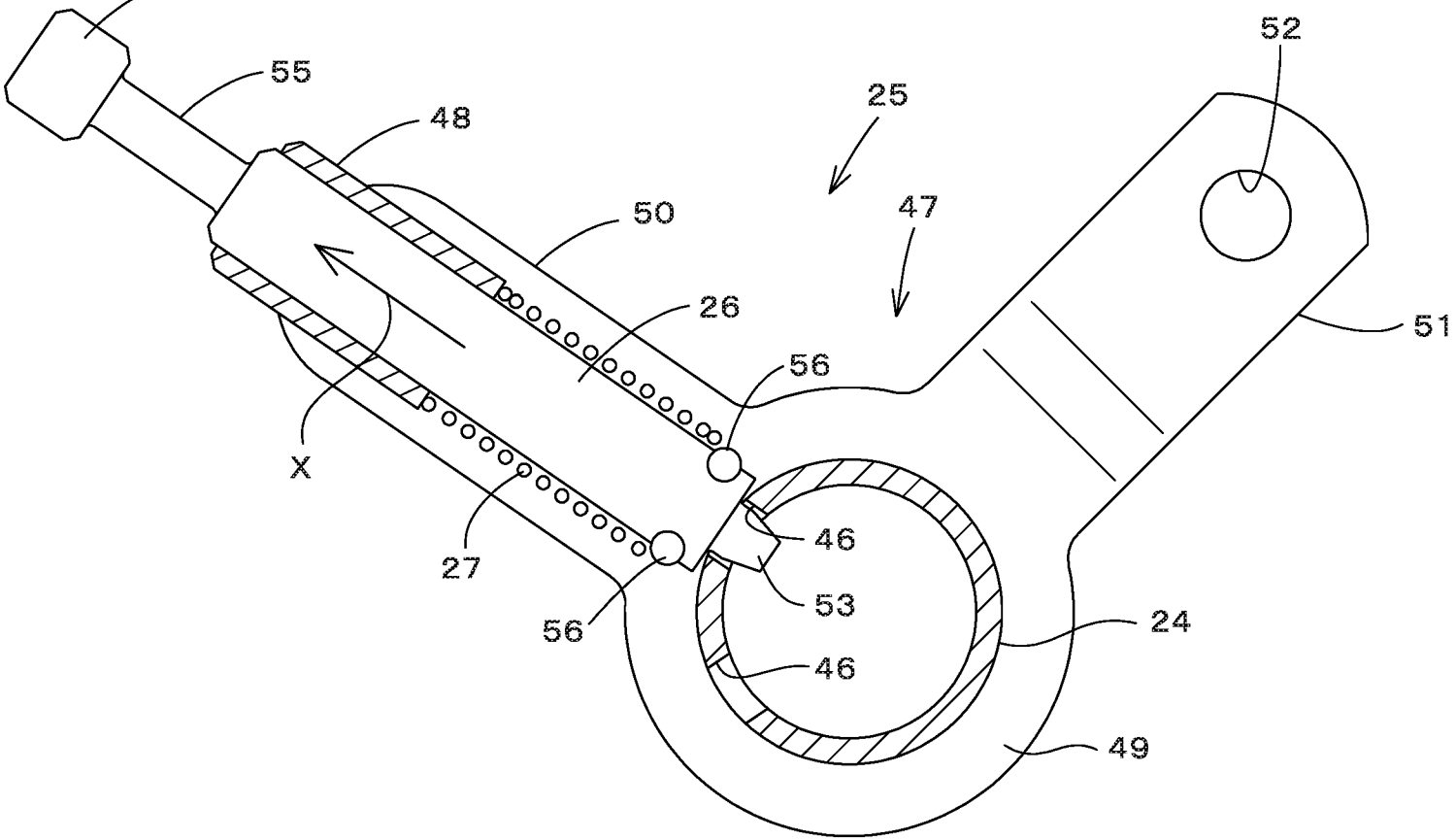
FIG. 4 is a side cross-sectional view illustrating a rotating operation member and an operation lever.

On a front side of the rotating support shaft 24, as illustrated in FIG. 4, an upper and lower pair of lock holes 46 (lock engagement parts) provided in a circumferential direction at an interval is formed with penetrating.

Figure 6A:
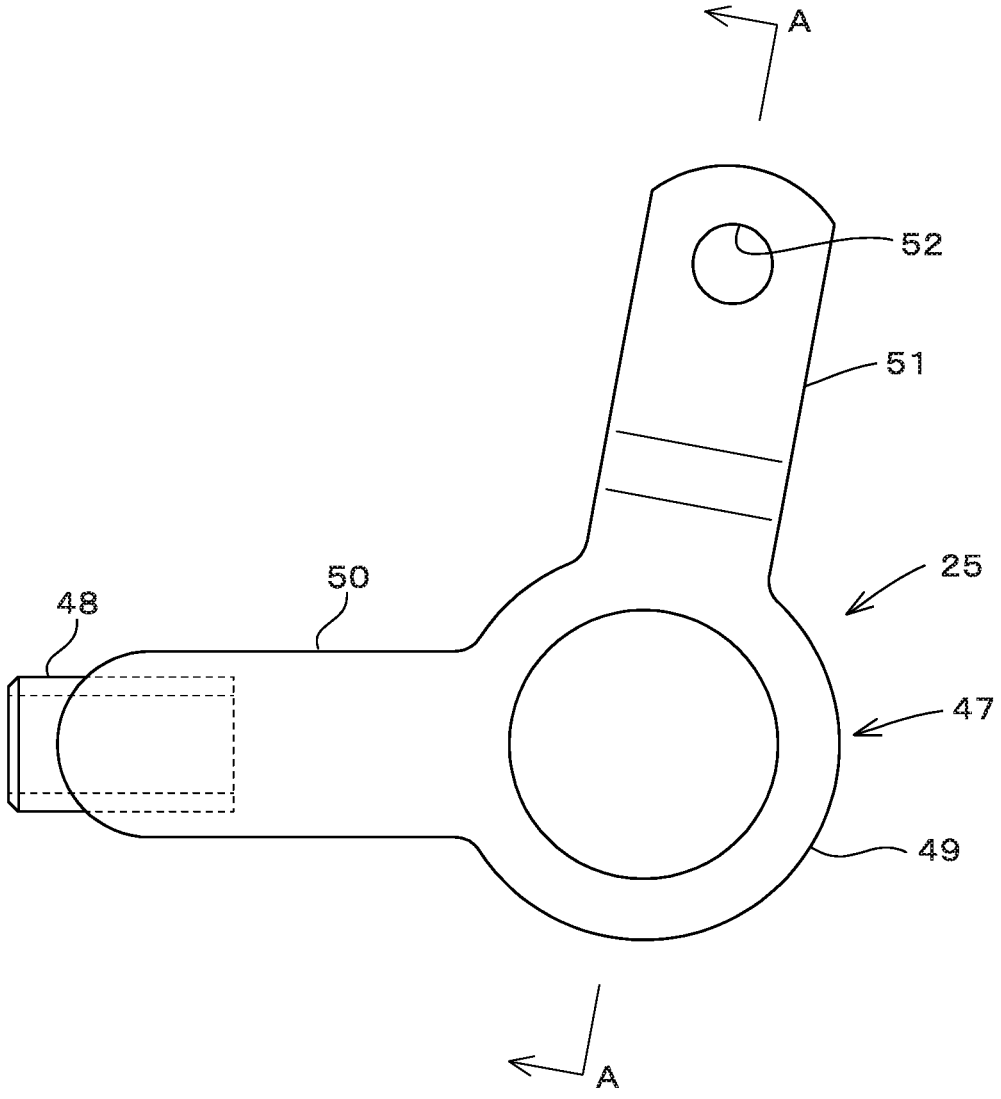
FIG. 6A is a side view of the rotating operation member.
Figure 6B:
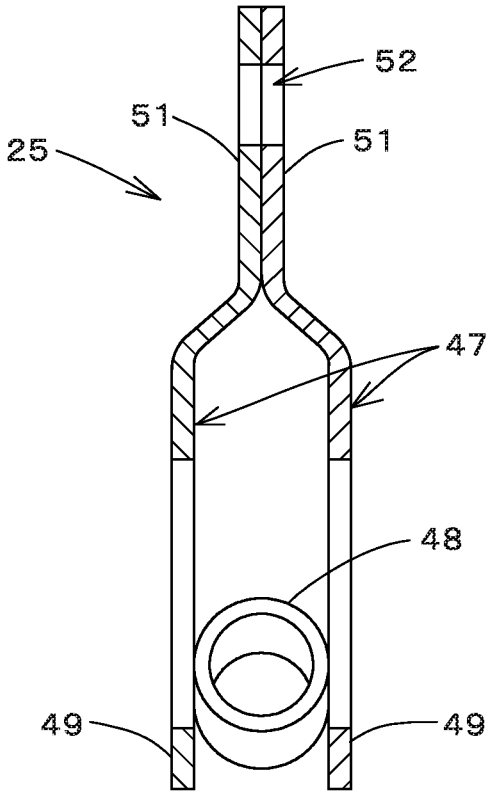
FIG. 6B is a cross-sectional view along an A-A line indicated by an arrow of FIG. 6A.

The rotating operation member 25 is, as illustrated in FIG. 6A and FIG. 6B, configured to include: a left and right pair of main components 47 formed of a plate material; and a guide tube 48 that guides the operation lever 26.

Each of the main components 47 is adapted such that a rotating support part 49 that is supported by the rotating support shaft 24 rotatably around the shaft center, a lever supporting part 50 that supports the operation lever 26, and interlocking arm part 51 that is interlocked with and connected to the operation arm 31 are integrally formed of one sheet of plate material.

The rotating support part 49 is formed in a ring-disk shape, and supported by the rotating support shaft 24 with being fitted at the outside of the rotating support shaft 24. The left and right rotating support parts 49 are positioned at an interval laterally so as to place the lock holes 46 therebetween.

The lever supporting part 50 is extended from the rotating support part 49 outward in a radial direction of the rotating support part 49 (outward in the radial direction of the rotating support shaft 24). The left and right lever supporting parts 50 are positioned at an interval laterally.

The interlocking arm part 51 is extended from the rotating support part 49 outward in the radial direction of the rotating support part 49 (outward in the radial direction of the rotating support shaft 24). Regarding the left and right interlocking arm parts 51, base end sides are bent such that the left and right interlocking arm parts 51 are overlapped each other with approaching each other from middle parts to fore end parts thereof, and the fore end sides are welded and fixed to each other as well as the middle parts being welded and fixed to each other. On the fore end sides of the left and right interlocking arm parts 51, pin insertion holes 52 formed with penetrating through the left and right interlocking arm parts 51 are formed, respectively.

The guide tube 48 is arranged between fore end sides of the left and right lever supporting parts 50, as well as, as illustrated in FIG. 4, being arranged such that an axial center thereof coincides with a direction orthogonal to the shaft center of the rotating support shaft 24, and welded and fixed to the left and right lever supporting parts 50.

As illustrated in FIG. 4, the operation lever 26 is formed of a rod material, and with being inserted into the guide tube 48, adapted to be movable in the axial center direction of the guide tube 48 (direction orthogonal to the shaft center of the rotating support shaft 24). On a side of the operation lever 26, which faces to the rotating support shaft 24, a locking protrusion part 53 (lock engaged part) that is insertably/removably insertable into any of the lock holes 46 is provided.

Also, on a side of the operation lever 26, which is opposite to the side where the locking protrusion part 53 is provided, a grip part 54 is provided. The grip part 54 is formed by scraping part of the operation lever 26 to form a small diameter part 55. Note that a grip formed as a separate body may be attached and fixed to the rod material forming the operation lever 26.

As illustrated in FIG. 4, the spring 27 is formed of a coil spring, and arranged between the guide tube 48 and the rotating support shaft 24 as well as being fitted to the operating lever 26 with covering the operating lever 26 between the guide tube 48 and the rotating support shaft 24. One end of the spring 27 touches an end part of the guide tube 48, and the other end touches a spring receiving part 56 provided on the fore end side of the operation lever 26. Accordingly, biasing force of the spring 27 acts in a direction in which the locking protrusion part 53 on the fore end side of the operation lever 26 is inserted into any of the lock holes 46.

The interlocking member 28 is formed of a link, and provided with connecting pins 57 on front and back end sides thereof. The front end side connecting pin 57 is inserted into the pin insertion holes 52 of the interlocking arm part 51 to pivotally connect the front end side of the interlocking member 28 to the interlocking arm part 51. The back end side connecting pin 57 is inserted into the pin insertion hole 32 of the operation arm 31 to pivotally connect the back end side of the interlocking member 28 to the operation arm 31.

In the operation pattern switching device 21 having the above-described configuration, as illustrated in FIG. 1, in a state where the locking protrusion part 53 is inserted into the upper side lock hole 46, the interlocking arm part 51 is positioned on a back side of the operation lever 26 (lever supporting part 50); the stopper pin 33 of the operation pattern switching valve 22 touches the back side regulation pin 34B; the operation pattern switching valve 22 is switched to the first pattern switching position; and the controlling devices 18L and 18R are set to one operation pattern of the first and second operation patterns.

Also, the locking protrusion part 53 of the operation lever 26 maintains a state of being inserted into the lock hole 46 by the biasing force of the spring 27, and in the state where the locking protrusion part 53 is inserted into the lock hole 46, the operation lever 26 and rotating operation member 25 do not move around the rotating support shaft 24, so that the operation pattern switching valve 22 is locked at the first pattern switching position.

By, from this state, gripping the grip part 54 of the operation lever 26, and pulling the operation lever 26 in an X direction indicated by an arrow in FIG. 4 against the biasing force of the spring 27 to remove the locking protrusion part 53 from the lock hole 46, the operation lever 26 and rotating operation member 25 are made rotatable around the rotating support shaft 24. Then, by pushing down the operation lever 26 while maintaining a state where the locking protrusion part 53 is removed from the lock hole 46, the interlocking arm swings forward to pull the interlocking member 28 forward, as well as the operation arm 31 being pulled forward by the interlocking member 28 to rotate the rotating spool 30, and the operation pattern switching valve 22 is switched to the second pattern switching position to switch the controlling devices 18L and 18R to the other operation pattern of the first and second operation patterns.

In a state where the operation pattern switching valve 22 is switched to the second pattern switching position, the locking protrusion part 53 is positioned at a position facing to the lower side lock hole 46 (at a position of being insertable into the lower side lock hole 46), and by, in this state, releasing force that pulls the operation lever 26, the operation lever 26 is moved to the rotating support shaft 24 side by the biasing force of the spring 27, and the locking protrusion part 53 is inserted into the lower side lock hole 46. In doing so, the operation lever 26 and rotating operation member 25 are made unmovable around the rotating support shaft 24, and therefore the operation pattern switching valve 22 is locked at the second pattern switching position.

In this manner, the switching operation of an operation pattern (the switching operation of the operation pattern switching valve 22), and the locking operation of the operation pattern switching valve 22 can be performed by a series of actions, and as compared with the case of separately performing the switching operation of an operation pattern and the locking operation of the operation pattern switching valve, operability is improved.

The operation lever 26 is assembled in such a manner that, in a state where the rotating operation member 25 is removed from the rotating support shaft 24, the spring 27 is inserted between the left and right lever supporting parts 50, and then the operation lever 26 is inserted into the spring 27 from the grip part 54 side and subsequently inserted into the guide tube 48. In this manner, the operation lever 26 can be easily assembled. Further, each of the lever supporting parts 50 is formed of a plate material, and also the left and right lever supporting parts 50 and rotating support parts 49 are respectively provided at intervals laterally, so that the insertion arrangement of the spring 27 can also be easily performed.

The rotating operation member 25 is assembled in such a manner that, with the operating lever 26 being pulled to prevent the locking protrusion part 53 from interfering with the rotating support shaft 24, the rotating support part 49 is fitted to the rotating support shaft 24 at the outside of the rotating support shaft 24. Then, with use of a retaining pin or the like, retaining of the rotating operation member 25 is performed on the rotating support shaft 24. In this manner, the rotating operation member 25 can also be easily assembled.

Further, in the operation pattern switching device 21 adapted to interlock with the operation pattern switching valve 22 through the interlocking member 28, the operation lever 26 and the locking mechanism are integrated, and therefore the number of parts is small, which enables the operation pattern switching device 21 to be provided at low cost and structure to be simplified.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The text of Japanese application No. 2012-171236 is hereby incorporated by reference.

The invention claimed is:

1. An operation pattern switching device having:

an operation pattern switching valve that is set in hydraulic pipe lines between a plurality of actuator control valves that is, in order to control a plurality of hydraulic actuators equipped in a working machine, provided corresponding to the plurality of hydraulic actuators, and controlling devices that perform pilot operations of the plurality of actuator control valves, and switches an operation pattern of the controlling devices for the plurality of actuator control valves to any of a plurality of operation patterns;

a rotating operation member that rotates with being supported by a rotating support shaft rotatably around a shaft center, and thereby performs a switching operation of the operation pattern switching valve; and an operation lever that is provided rotatably integrally with the rotating operation member and performs a rotating operation of the rotating operation member, wherein:

the rotating support shaft is, in order to lock the rotating operation member at each switching position of the operation pattern switching valve, in a circumferential direction, provided with a plurality of lock engagement parts each with which the operation lever engages; and the operation lever is supported by the rotating operation member movably in a direction orthogonal to a shaft center of the rotating support shaft, and also moves in the moving direction to be thereby removably engagable with each of the lock engagement parts.

2. The operation pattern switching device according to claim 1, wherein:

the rotating operation member is, in a shaft center direction of the rotating support shaft, provided with a pair of main components formed of a plate material;

each of the main components is provided with a rotating support part that is supported by the rotating support shaft rotatably around the shaft center with being fitted at an outside of the rotating support shaft, and a lever supporting part that extends from the rotating support part outward in a radial direction of the rotating support shaft;

the rotating support parts and the lever supporting parts are respectively provided at intervals in the shaft center direction of the rotating support shaft;

on a fore end side between the lever supporting parts, a guide tube that guides the operation lever movably in the direction orthogonal to the shaft center of the rotating support shaft; and between the guide tube and the rotating support shaft, a spring that biases the operation lever such that the operation lever engages with any of the lock engagement parts is provided.

3. The operation pattern switching device according to claim 2, wherein:

each of the main components of the rotating operation member is provided with an interlocking arm that is extended from the rotating support part and interlocked with and connected to the operation pattern switching valve through an interlocking member; and the rotating support part, the lever supporting part, and the interlocking arm part are formed of one sheet of plate material.

4. The operation pattern switching device according to claim 1, wherein:

the rotating support shaft is configured to include a cylindrical member;

the lock engagement parts are respectively configured to be lock holes that are formed in the cylindrical member with penetrating; and the operation lever has a locking protrusion part that is insertably/removably inserted into any of the lock engagement parts to thereby lock the rotating operation member.

5. The operation pattern switching device according to claim 1, wherein:

the working machine has a machine body that is mounted on a traveling body so as to be revolvable around a vertical pivot center, and a front operating unit that is equipped on a front side of the machine body, the machine body is driven by a revolving motor, and the front operating unit has a boom driven by a boom cylinder, an arm driven by an arm cylinder, and a bucket driven by a bucket cylinder;

the controlling devices are ones that perform the pilot operations of a revolving control valve controlling the revolving motor, an arm control valve controlling the arm cylinder, a bucket control valve controlling the bucket cylinder, and a boom control valve controlling the boom cylinder; and the operation pattern switching valve is one that switches the operation pattern of the controlling devices for the revolving control valve, the arm control valve, the bucket control valve, and the boom control valve.

* * * * *